US011766863B2

(12) United States Patent
Fukuda et al.

(10) Patent No.: US 11,766,863 B2
(45) Date of Patent: Sep. 26, 2023

(54) LIQUID DISCHARGE HEAD AND RECORDING DEVICE

(71) Applicant: KYOCERA CORPORATION, Kyoto (JP)

(72) Inventors: Yasuhiko Fukuda, Kirishima (JP); Masaru Iwabuchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 93 days.

(21) Appl. No.: 17/618,872

(22) PCT Filed: Jun. 9, 2020

(86) PCT No.: PCT/JP2020/022631

§ 371 (c)(1),
(2) Date: Dec. 13, 2021

(87) PCT Pub. No.: WO2020/250873

PCT Pub. Date: Dec. 17, 2020

(65) Prior Publication Data

US 2022/0258467 A1 Aug. 18, 2022

(30) Foreign Application Priority Data

Jun. 14, 2019 (JP) ..... 2019-110826

(51) Int. Cl.
*B41J 2/14* (2006.01)

(52) U.S. Cl.
CPC ..... *B41J 2/14209* (2013.01); *B41J 2/1408* (2013.01); *B41J 2002/14225* (2013.01); *B41J 2002/14306* (2013.01); *B41J 2002/14459* (2013.01); *B41J 2202/08* (2013.01)

(58) Field of Classification Search
CPC ..... B41J 2/14209; B41J 2/1408; B41J 2002/14225; B41J 2002/14306; B41J 2002/14459; B41J 2202/08
See application file for complete search history.

(56) References Cited

U.S. PATENT DOCUMENTS

| | | | | |
|---|---|---|---|---|
| 10,315,447 | B2 | 6/2019 | Gejima | |
| 10,773,520 | B2 * | 9/2020 | Mori | B41J 2/14 |
| 2013/0076838 | A1 | 3/2013 | Suzuki et al. | |

FOREIGN PATENT DOCUMENTS

| | | | | |
|---|---|---|---|---|
| CN | 205058835 | U | 3/2016 | |
| CN | 107107612 | A | 8/2017 | |
| EP | 2894033 | A1 | 7/2015 | |
| JP | 9-76485 | * | 3/1997 | B41J 2202/08 |
| JP | 201678355 | A | 5/2016 | |
| WO | 2016104480 | A1 | 6/2016 | |

* cited by examiner

*Primary Examiner* — Geoffrey S Mruk
(74) *Attorney, Agent, or Firm* — HAUPTMAN HAM, LLP

(57) ABSTRACT

A liquid discharge head includes a head body, a driver IC, a housing, a heat dissipation plate, and a pressing member. The head body includes a discharge hole configured to discharge a liquid. The driver IC controls driving of the head body. The housing is located on the head body, and includes an opening at a side surface. The heat dissipation plate is located at the opening of the housing, and is configured to dissipate heat generated by the driver IC. The pressing member presses the driver IC against the heat dissipation plate. In addition, the heat dissipation plate is fixed to the pressing member.

15 Claims, 14 Drawing Sheets

LIQUID DISCHARGE HEAD AND RECORDING DEVICE

RELATED APPLICATIONS

The present application is a National Phase of International Application No. PCT/JP2020/022631 filed Jun. 9, 2020, which claims priority to Japanese Application No. 2019-110826, filed Jun. 14, 2019.

TECHNICAL FIELD

The disclosed embodiments relate to a liquid discharge head and a recording device.

BACKGROUND ART

Inkjet printers and inkjet plotters that utilize inkjet recording methods are known as printing apparatuses. In such inkjet printing apparatuses, a liquid discharge head for discharging liquid is mounted.

In order to bring a driver IC into close contact with a heat dissipation plate, such a liquid discharge head includes a pressing member configured to press the driver IC toward the heat dissipation plate from a back side of the driver IC (see, for example, Patent Document 1).

CITATION LIST

Patent Document

Patent Document 1: WO 2016/104480

SUMMARY

A liquid discharge head according to one aspect of an embodiment includes a head body, a driver IC, a housing, a heat dissipation plate, and a pressing member. The head body includes a discharge hole configured to discharge a liquid. The driver IC controls driving of the head body. The housing is located on the head body, and includes an opening at a side surface. The heat dissipation plate is located at the opening of the housing, and dissipates heat generated by the driver IC. The pressing member presses the driver IC against the heat dissipation plate. The heat dissipation plate is fixed to the pressing member.

In addition, a recording device according to one aspect of the embodiment includes the liquid discharge head described above, a conveyor, and a controller. The conveyor conveys a recording medium to the liquid discharge head. The controller controls the driver IC of the liquid discharge head.

DESCRIPTION OF EMBODIMENTS

In a case of a typical liquid discharge head, if a pressing member does not have a predetermined shape, a driver IC cannot be sufficiently pressed against a heat dissipation plate. This causes a problem in that it is difficult to bring the driver IC into close contact with the heat dissipation plate.

According to one aspect of the embodiment, it is possible to provide a liquid discharge head capable of favorably bringing a driver IC into close contact with a heat dissipation plate, and a recording device.

Embodiments of a liquid discharge head and a recording device disclosed in the present application will be described in detail below with reference to the accompanying drawings. Note that the present invention is not limited to the embodiments that will be described below.

Inkjet printers and inkjet plotters that utilize an inkjet recording method are known as printing apparatuses. A liquid discharge head for discharging liquid is mounted in printing apparatuses using such an inkjet method.

A piezoelectric method is another method for discharging liquid from a liquid discharge head. In a liquid discharge head that uses such a piezoelectric method, a part of a wall of an ink channel is bent and displaced by a displacement element to mechanically pressurize and discharge the ink in the ink channel. In addition, in order to drive such a piezoelectric element, the liquid discharge head includes a driver IC.

In addition, in order to bring the driver IC into close contact with the heat dissipation plate, the liquid discharge head includes a pressing member configured to press the driver IC toward the heat dissipation plate from a back side of the driver IC. This makes it possible to favorably dissipate, from the driver IC, heat generated at the time of driving the piezoelectric element.

However, in a case of a typical liquid discharge head, if a pressing member does not have a predetermined shape due to variation at the time of manufacturing or deformation or the like at the time of assembly, the driver IC cannot be sufficiently pressed against the heat dissipation plate. This makes it difficult to bring the driver IC into close contact with the heat dissipation plate. For this reason, there is a possibility that heat generated at the time of driving the piezoelectric element cannot be sufficiently dissipated from the driver IC.

Thus, it has been desired to realize a liquid discharge head and a recording device capable of overcoming the problem described above and bringing the driver IC into close contact with the heat dissipation plate even in a case where the pressing member does not have a predetermined shape.

Printer Configuration

Figure 1:
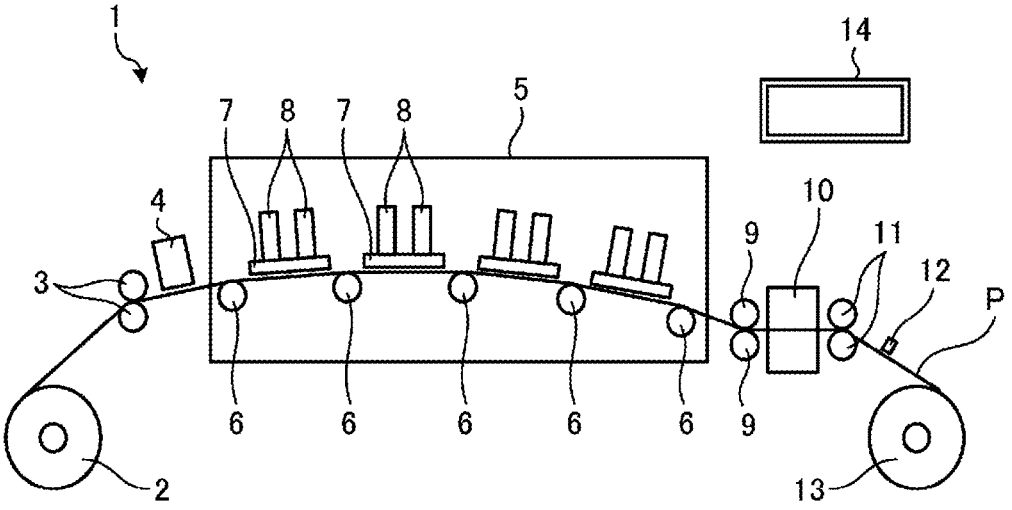
FIG. 1 is an explanatory view (No. 1) illustrating a recording device according to an embodiment.
Figure 2:
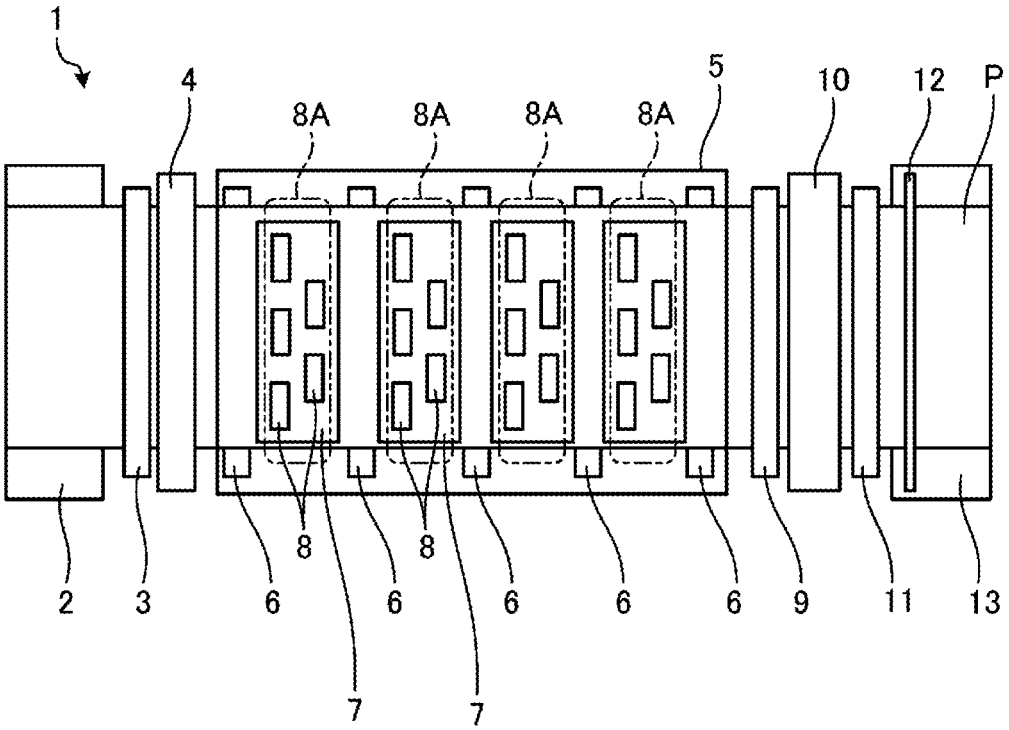
FIG. 2 is an explanatory view (No. 2) illustrating the recording device according to the embodiment.

First, a description will be given on an overview of a printer 1 that is one example of a recording apparatus according to an embodiment, with reference to FIGS. 1 and 2. FIGS. 1 and 2 are explanatory views of the printer 1 according to the embodiment.

Specifically, FIG. 1 is a schematic side view of the printer 1 and FIG. 2 is a schematic plan view of the printer 1. The printer 1 according to the embodiment is, for example, a color inkjet printer.

As illustrated in FIG. 1, the printer 1 includes a paper feed roller 2, guide rollers 3, an applicator 4, a head case 5, a plurality of conveying rollers 6, a plurality of frames 7, a plurality of liquid discharge heads 8, conveying rollers 9, a dryer 10, conveying rollers 11, a sensor 12, and a collection roller 13. The conveying rollers 6 are examples of a conveyor.

The printer 1 includes a controller 14 that controls the paper feed roller 2, the guide rollers 3, the applicator 4, the head case 5, the plurality of conveying rollers 6, the plurality of frames 7, the plurality of liquid discharge heads 8, the conveying rollers 9, the dryer 10, the conveying rollers 11, the sensor 12, and the collection roller 13.

By landing droplets on the printing sheet P, the printer 1 records images and characters on the printing sheet P. The printing sheet P is an example of a recording medium. The printing sheet P is rolled on the paper feed roller 2 prior to use. In this state, the printer 1 conveys the printing sheet P from the paper feed roller 2 to the inside of the head case 5 via the guide rollers 3 and the applicator 4.

The applicator 4 uniformly applies a coating agent over the printing sheet P. With surface treatment thus performed on the printing sheet P, the printing quality of the printer 1 can be improved.

The head case 5 houses the plurality of conveying rollers 6, the plurality of frames 7, and the plurality of liquid discharge heads 8. The inside of the head case 5 is formed with a space separated from the outside except for a part connected to the outside such as parts where the printing sheet P enters and exits.

If necessary, the controller 14 controls at least one of controllable factors of the internal space of the head case 5, such as temperature, humidity, and barometric pressure. The conveying rollers 6 convey the printing sheet P to the vicinity of the liquid discharge heads 8, inside the head case 5.

The frames 7 are rectangular flat plates, and are positioned above and close to the printing sheet P conveyed by the conveying rollers 6. As illustrated in FIG. 2, the frames 7 are positioned such that the longitudinal direction of the frames 7 is orthogonal to the conveyance direction of the printing sheet P. Furthermore, the plurality of (e.g., four) frames 7 are located inside the head case 5 along the conveyance direction of the printing sheet P.

Note that, in the following description, a direction in which a printing sheet P is transferred is also referred to as a "sub scanning direction," and a direction orthogonal to this sub scanning direction and parallel to the printing sheet P is also referred to as a "main scanning direction".

Liquid, for example, ink, is supplied to the liquid discharge heads 8 from a liquid tank (not illustrated). Each liquid discharge head 8 discharges the liquid supplied from the liquid tank.

The controller 14 controls the liquid discharge heads 8 based on data of an image, characters, and the like to discharge the liquid toward the printing sheet P. The distance between each liquid discharge head 8 and the printing sheet P is, for example, approximately 0.5 to approximately 20 mm.

The liquid discharge heads 8 are fixed to the frame 7. For example, the liquid discharge heads 8 are fixed to the frame 7 at both end portions in the longitudinal direction. The liquid discharge heads 8 are positioned such that the longitudinal direction of the liquid discharge heads 8 is orthogonal to the conveyance direction of the printing sheet P.

That is, the printer 1 according to the embodiment is a so-called line printer in which the liquid discharge heads 8 are fixed inside the printer 1. Note that the printer 1 according to the embodiment is not limited to a line printer and may also be a so-called serial printer.

A serial printer is a printer employing a method of alternately performing operations of recording while moving the liquid discharge heads 8 in a manner such as reciprocation in a direction intersecting (e.g., substantially orthogonal to) the conveyance direction of the printing sheet P, and conveying the printing sheet P.

As illustrated in FIG. 2, a plurality of (e.g., five) liquid discharge heads 8 are fixed to one frame 7. FIG. 2 illustrates an example in which three liquid discharge heads 8 are located on the forward side and two liquid discharge heads 8 are located on the rear side, in the conveyance direction of the printing sheet P. Further, the liquid discharge heads 8 are positioned without their centers overlapping in the conveyance direction of the printing sheet P.

The plurality of liquid discharge heads 8 positioned in one frame 7 form a head group 8A. Four head groups 8A are positioned along the conveyance direction of the printing sheet P. The liquid discharge heads 8 belonging to the same head group 8A are supplied with ink of the same color. As a result, the printer 1 can perform printing with four colors of ink using the four head groups 8A.

The colors of the ink discharged from the respective head groups 8A are, for example, magenta (M), yellow (Y), cyan (C), and black (K). The controller 14 can print a color image on the printing sheet P by controlling each of the head groups 8A to discharge the plurality of colors of ink onto the printing sheet P.

Note that a surface treatment may be performed on the printing sheet P, by discharging a coating agent from the liquid discharge heads 8 onto the printing sheet P.

Furthermore, the number of the liquid discharge heads 8 included in one head group 8A and the number of the head groups 8A provided in the printer 1 can be changed as appropriate in accordance with printing targets and printing conditions. For example, if the color to be printed on the printing sheet P is a single color and the range of the printing can be covered by a single liquid discharge head 8, only a single liquid discharge head 8 may be provided in the printer 1.

The printing sheet P thus subjected to the printing process inside the head case 5 is conveyed by the conveying rollers 9 to the outside of the head case 5, and passes through the inside of the dryer 10. The dryer 10 dries the printing sheet P after the printing process. The printing sheet P thus dried by the dryer 10 is conveyed by the conveying rollers 11 and then collected by the collection roller 13.

In the printer 1, by drying the printing sheet P with the dryer 10, it is possible to suppress bonding between the printing sheets P rolled while being overlapped with each other, and rubbing between undried liquid at the collection roller 13.

The sensor 12 includes a position sensor, a speed sensor, a temperature sensor, and the like. Based on information from the sensor 12, the controller 14 can determine the state of each part of the printer 1 and control each part of the printer 1.

In the printer 1 described above, the printing sheet P is the printing target (i.e., the recording medium), but the printing target in the printer 1 is not limited to the printing sheet P, and a roll type fabric or the like may be the printing target.

Furthermore, instead of directly conveying the printing paper P, the printer 1 may have a configuration in which the printing sheet P is put on a conveyor belt and conveyed. By using the conveyor belt, the printer 1 can perform printing on a sheet of paper, a cut cloth, wood, a tile, or the like as a printing target.

Furthermore, the printer 1 may discharge a liquid containing electrically conductive particles from the liquid discharge heads 8, to print a wiring pattern or the like of an electronic device. Furthermore, the printer 1 may discharge liquid containing a predetermined amount of liquid chemical agent or liquid containing the chemical agent from the liquid discharge heads 8 onto a reaction vessel or the like to produce chemicals.

The printer 1 may also include a cleaner for cleaning the liquid discharge heads 8. The cleaner cleans the liquid discharge heads 8 by, for example, a wiping process or a capping process.

The wiping process is, for example, a process of using a flexible wiper to rub a second surface 21*b* (see FIG. 6) of a channel member 21 (see FIG. 3), which is an example of a surface of a portion from which a liquid is discharged, thereby removing the liquid attached to the second surface 21*b*.

The capping process is performed as follows, for example. First, a cap is provided so as to cover the second surface 21*b* of the channel member 21 which is an example of the portion from which the liquid is discharged (this action is referred to as capping). This action forms a substantially sealed space between the second surface 21*b* and the cap.

The discharge of liquid is then repeated in such a sealed space. Consequently, it is possible to remove a liquid having a viscosity higher than that in the normal state, foreign matter, or the like that has clogged a discharge hole 63 (see FIG. 4).

Configuration of Liquid Discharge Head

Figure 3:
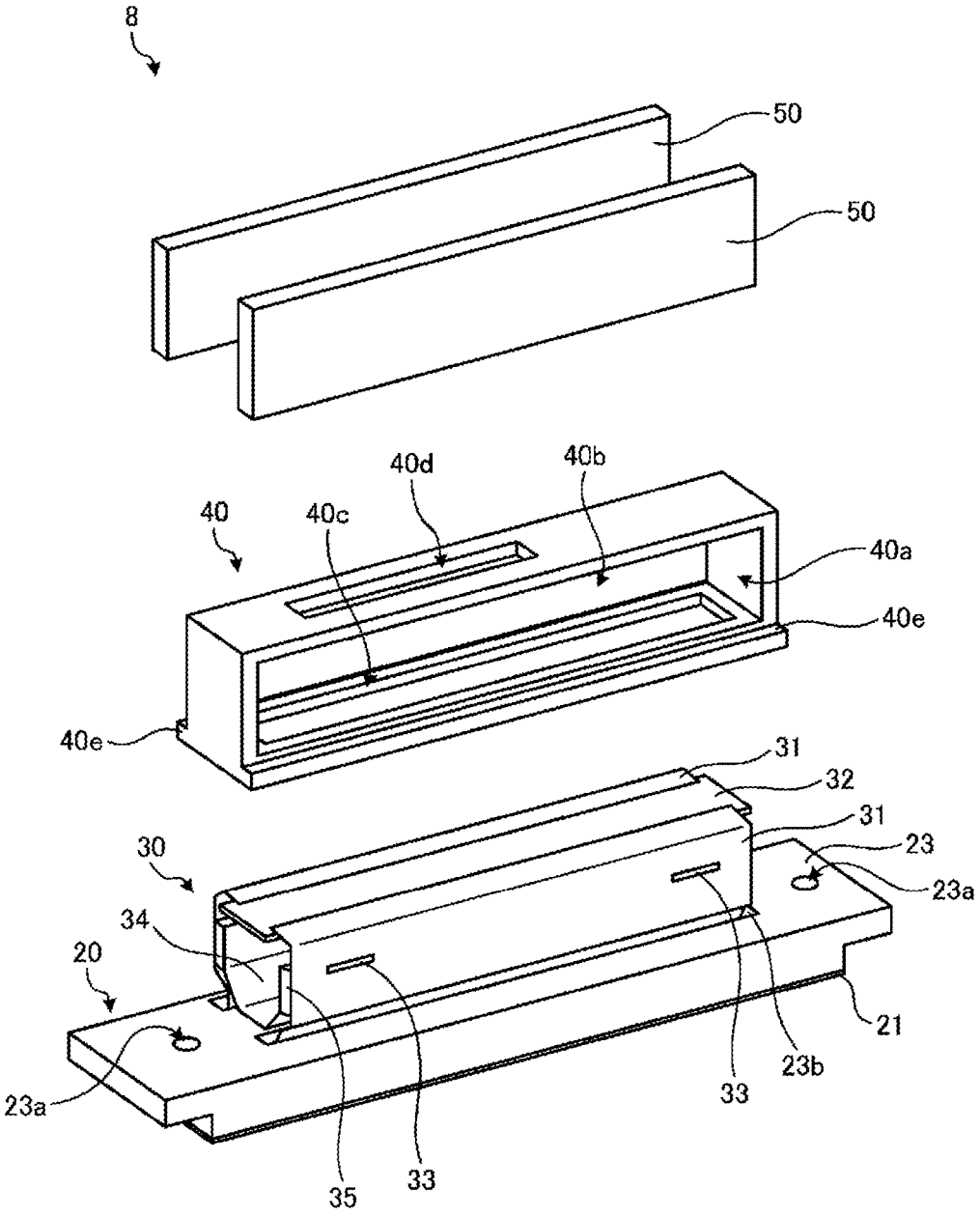
FIG. 3 is an exploded perspective view illustrating a schematic configuration of a liquid discharge head according to the embodiment.

Next, the configuration of the liquid discharge head 8 according to the embodiment will be described with reference to FIG. 3. FIG. 3 is an exploded perspective view illustrating a schematic configuration of the liquid discharge head 8 according to the embodiment.

The liquid discharge head 8 includes a head body 20, a wiring portion 30, a housing 40, and a pair of heat dissipation plates 50. The head body 20 includes the channel member 21, a piezoelectric actuator substrate 22 (see FIG. 4), and a reservoir 23.

Note that, in the following description, for the purpose of convenience, a direction in which the head body 20 is provided in the liquid discharge head 8 is referred to as "downward," and a direction in which the housing 40 is provided relative to the head body 20 is referred to as "upward".

The channel member 21 of the head body 20 has a substantially flat plate shape, and includes a first surface 21*a* (see FIG. 6), which is one main surface, and the second surface 21*b* (see FIG. 6) located at an opposite side from the first surface 21*a*. The first surface 21*a* has an opening 61*a* (see FIG. 4), and a liquid is supplied into the channel member 21 from the reservoir 23 through the opening 61*a*.

A plurality of the discharge holes 63 (see FIG. 4) used to discharge a liquid onto the printing sheet P are located at the second surface 21*b*. Furthermore, a channel through which a liquid flows from the first surface 21*a* to the second surface 21*b* is formed inside the channel member 21. Details of the channel member 21 will be described later.

The piezoelectric actuator substrate 22 is located on the first surface 21*a* of the channel member 21. The piezoelectric actuator substrate 22 includes a plurality of displacement elements 70 (see FIG. 5). In addition, a signal transmission member 31 of the wiring portion 30 is electrically connected to the piezoelectric actuator substrate 22. The piezoelectric actuator substrate 22 will be described in detail later.

The reservoir 23 is disposed on the piezoelectric actuator substrate 22. The reservoir 23 includes an opening 23*a* at both end portions thereof in the main scanning direction. The reservoir 23 has a channel therein, and is supplied with a liquid from the outside through the opening 23*a*. The reservoir 23 has a function of supplying the liquid to the channel member 21 and a function of storing the liquid to be supplied.

The wiring portion 30 includes the signal transmission member 31, a wiring board 32, a driver IC 33, a pressing member 34, and an elastic member 35. The signal transmission member 31 has a function of transferring a predetermined signal sent from the outside to the head body 20. Note that, as illustrated in FIG. 3, the liquid discharge head 8 according to the embodiment includes two signal transmission members 31.

Each of the signal transmission members 31 has one end portion electrically connected to the piezoelectric actuator substrate 22 of the head body 20. The other end of the signal transmission member 31 is drawn upward so as to be inserted into an opening 23*b* of the reservoir 23, and is electrically connected to the wiring board 32.

This enables the piezoelectric actuator substrate 22 of the head body 20 and the outside to be electrically connected. The signal transmission member 31 consists of, for example, a flexible printed circuit (FPC) or the like.

The wiring board 32 is located above the head body 20. The wiring board 32 has a function of distributing a signal to the driver IC 33.

The driver IC 33 is provided at one main surface of the signal transmission member 31. As illustrated in FIG. 3, in the liquid discharge head 8 according to the embodiment, two driver ICs 33 are provided on one signal transmission member 31. Note that, in the embodiment, the number of driver ICs 33 provided on one signal transmission member 31 is not limited to two.

The driver IC 33 drives the piezoelectric actuator substrate 22 of the head body 20 on the basis of a signal transmitted from the controller 14 (see FIG. 1). With this configuration, the driver IC 33 drives the liquid discharge head 8.

The pressing member 34 is substantially U-shaped in a cross-sectional view, and is configured to press the driver IC 33 on the signal transmission member 31 toward the heat dissipation plate 50 from the inner side. With this configuration, the embodiment enables heat generated when the driver IC 33 drives to be efficiently dissipated to the heat dissipation plate 50 on the outer side.

The elastic member 35 is positioned so as to be in contact with an outer wall of a pressing portion 34*a* (see FIG. 7A and FIG. 7B) of the pressing member 34. With the elastic member 35 being provided, it is possible to reduce the likelihood of the pressing member 34 damaging the signal transmission member 31 at the time when the pressing member 34 presses the driver IC 33.

The elastic member 35 is made of, for example, double-sided foam tape or the like. In addition, for example, by using a non-silicon-based thermal conductive sheet for the elastic member 35, it is possible to improve the heat dissipating property of the driver IC 33. Note that the elastic member 35 does not necessarily have to be provided.

The housing 40 is disposed on the head body 20 so as to cover the wiring portion 30. This enables the wiring portion 30 to be sealed with the housing 40. The housing 40 is made of, for example, a resin or a metal or the like.

The housing 40 has a box shape elongated in the main scanning direction, and includes a first opening 40*a* and a second opening 40*b* at side surfaces opposed in the sub scanning direction. The first opening 40*a* and the second opening 40*b* are examples of an opening. In addition, the housing 40 includes a third opening 40*c* at a lower surface, and includes a fourth opening 40*d* at an upper surface.

One of the heat dissipation plates 50 is disposed on the first opening 40*a* so as to close the first opening 40*a*. The other of the heat dissipation plates 50 is disposed on the second opening 40*b* so as to close the second opening 40*b*.

The heat dissipation plates 50 are provided so as to extend in the main scanning direction, and are made of a metal, an alloy, or the like having a high heat dissipating property. The heat dissipation plates 50 are provided so as to be in contact with the driver ICs 33, and have a function of dissipating heat generated by the driver ICs 33.

Figures 7A, 7B:
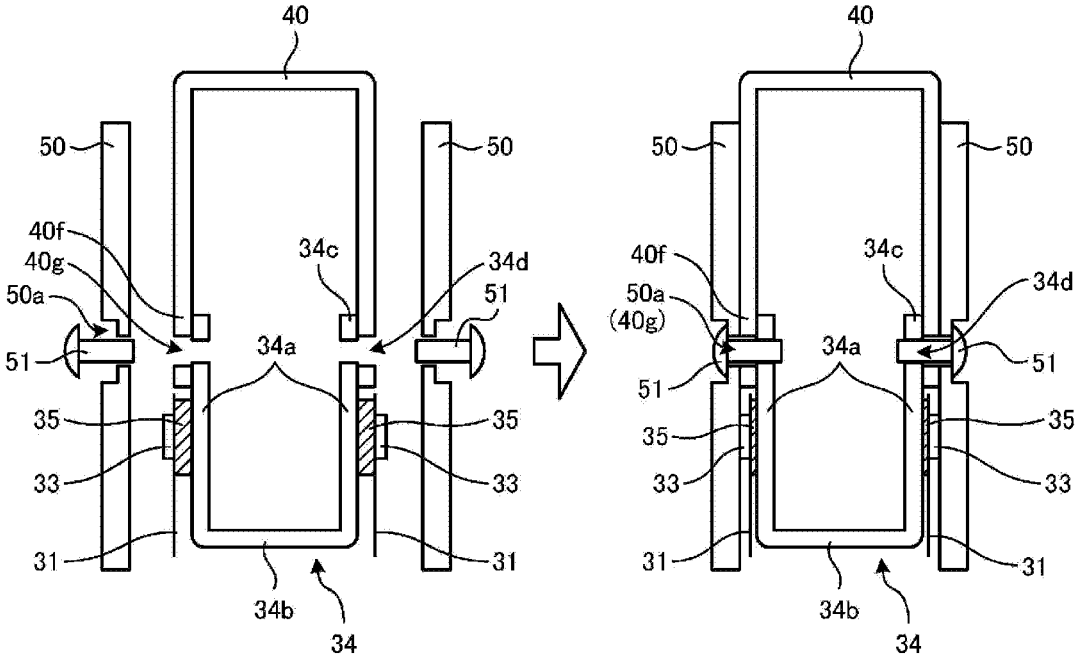
FIG. 7A and FIG. 7B are cross-sectional schematic views used to explain a structure of a pressing member according to the embodiment and a structure around the pressing member.

The pair of heat dissipation plates 50 are each fixed to the housing 40 with screws 51 (see FIG. 7A and FIG. 7B). Thus, the housing 40 to which the heat dissipation plates 50 are fixed has a box shape in which the first opening 40*a* and the second opening 40*b* are closed and the third opening 40*c* and the fourth opening 40*d* are open.

The third opening 40*c* is provided so as to be opposed to the reservoir 23. The signal transmission member 31 and the pressing member 34 are inserted into the third opening 40*c*.

The fourth opening 40*d* is provided in order to insert a connector (not illustrated) provided on the wiring board 32. It is preferable that a portion between the connector and the fourth opening 40*d* be sealed using resin or the like. This makes it possible to suppress entry of a liquid, dust, or the like into the housing 40.

Furthermore, the housing 40 includes thermal insulation portions 40*e*. The thermal insulation portions 40*e* are respectively provided so as to be adjacent to the first opening 40*a* and the second opening 40*b*, and are provided so as to protrude outward from side surfaces of the housing 40 that are opposed to each other in the sub scanning direction.

In addition, the thermal insulation portions 40*e* are formed so as to extend in the main scanning direction. That is, the thermal insulation portions 40*e* are located between the heat dissipation plates 50 and the head body 20. By providing the housing 40 with the thermal insulation portions 40*e* in this manner, it is possible to suppress transfer of heat generated by the driver ICs 33 through the heat dissipation plates 50 to the head body 20.

Note that the liquid discharge head 8 may further include a member other than the member illustrated in FIG. 3.

Configuration of Head Body

Figure 4:
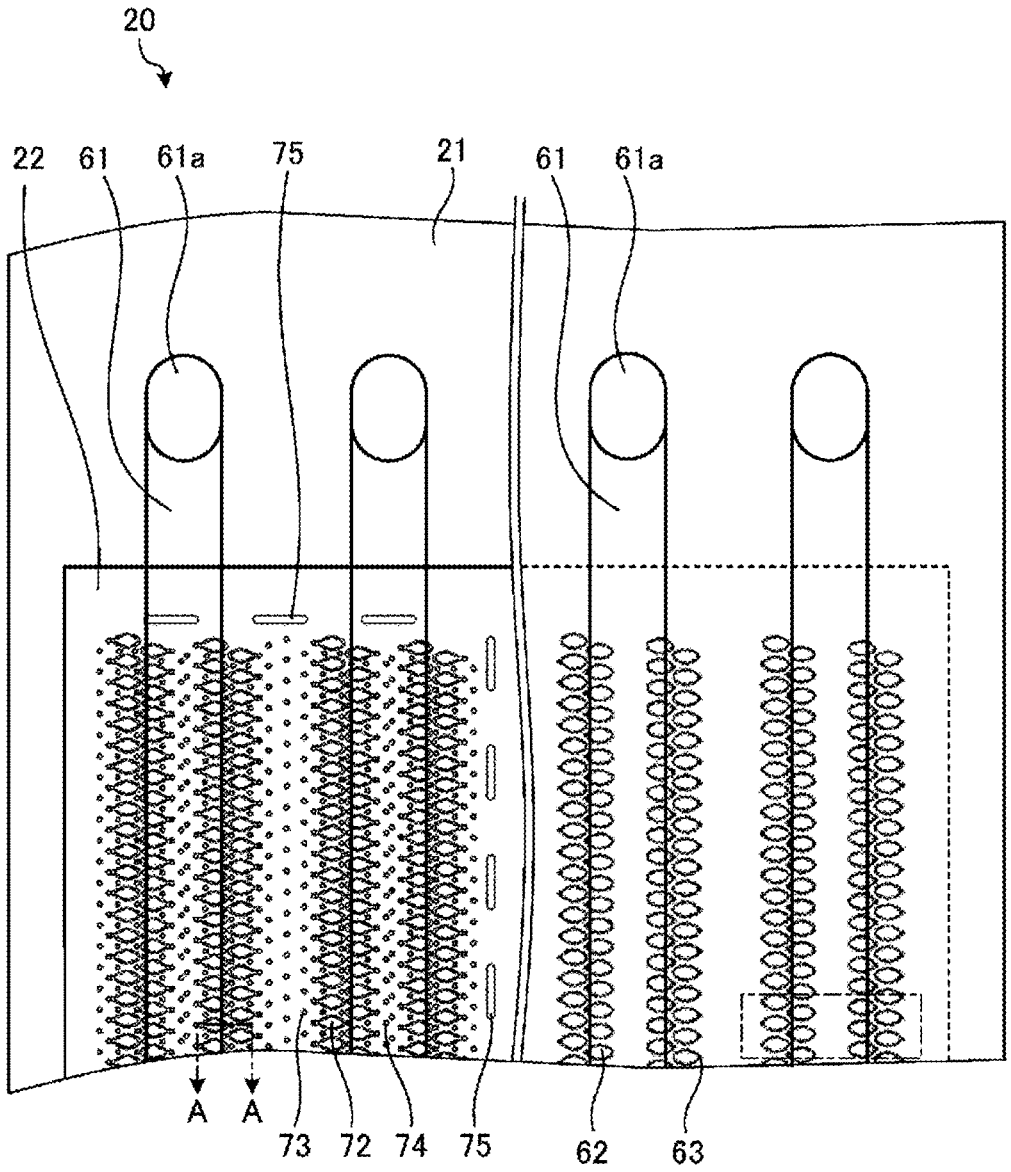
FIG. 4 is an enlarged plan view illustrating the liquid discharge head illustrated in FIG. 3.
Figure 5:
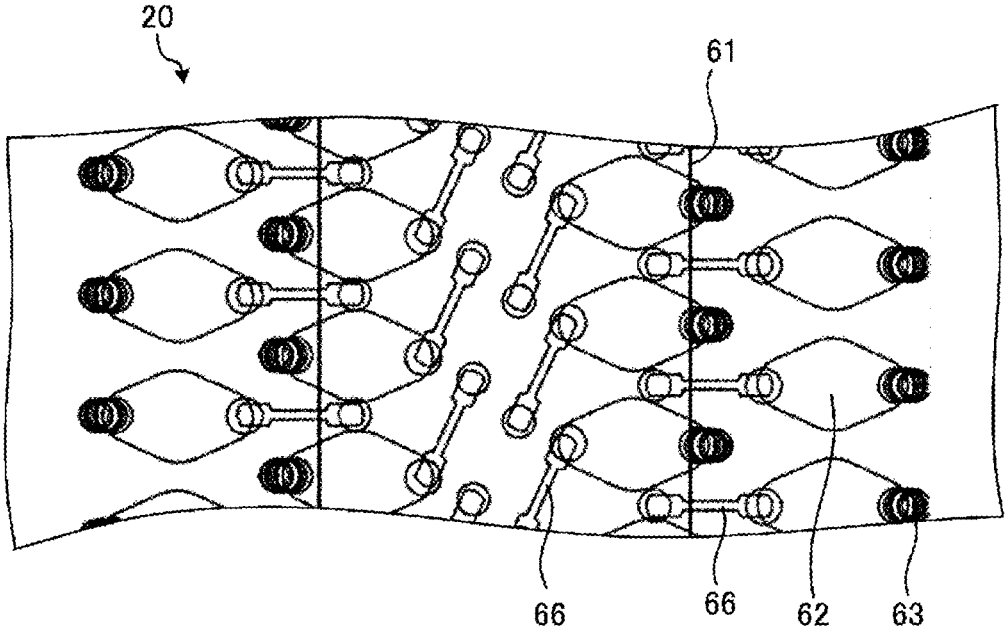
FIG. 5 is an enlarged view of a region surrounded by the long-dashed short-dashed line illustrated in FIG. 4.
Figure 6:
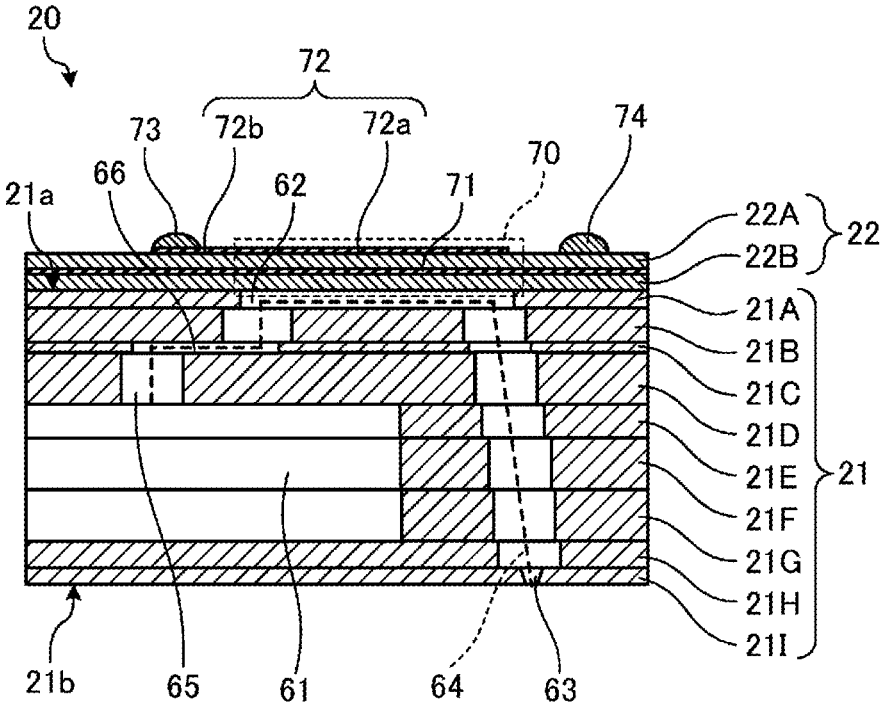
FIG. 6 is a cross-sectional view taken along the line A-A illustrated in FIG. 4.

Next, the configuration of the head body 20 according to the embodiment will be described with reference to FIGS. 4 to 6. FIG. 4 is an enlarged plan view of the head body 20 according to the embodiment. FIG. 5 is an enlarged view of a region surrounded by a dot-dash line illustrated in FIG. 4. FIG. 6 is a cross-sectional view taken along line A-A in FIG. 4.

As illustrated in FIG. 4, the head body 20 includes the channel member 21 and the piezoelectric actuator substrate 22. The channel member 21 includes a supply manifold 61, a plurality of pressurizing chambers 62, and a plurality of discharge holes 63.

The plurality of pressurizing chambers 62 are connected to the supply manifold 61. The plurality of discharge holes 63 are each connected to a corresponding one of the plurality of pressurizing chambers 62.

Each of the pressurizing chambers 62 opens to the first surface 21*a* (see FIG. 6) of the channel member 21. Furthermore, the first surface 21*a* of the channel member 21 has an opening 61*a* that communicates with the supply manifold 61. In addition, a liquid is supplied from the reservoir 23 (see FIG. 2) through the opening 61*a* to the inside of the channel member 21.

In the example illustrated in FIG. 4, the head body 20 has four supply manifolds 61 located inside the channel member 21. Each of the supply manifolds 61 has a long thin shape extending along the longitudinal direction (that is, in the main scanning direction) of the channel member 21. At both ends of the supply manifold 61, the opening 61*a* of the supply manifold 61 is formed on the first surface 21*a* of the channel member 21.

In the channel member 21, a plurality of pressurizing chambers 62 are formed so as to expand two-dimensionally. As illustrated in FIG. 5, each of the pressurizing chambers 62 is a hollow region having a substantially diamond planar shape with corner portions being rounded. The pressurizing chamber 62 opens to the first surface 21*a* of the channel member 21, and is closed by the piezoelectric actuator substrate 22 being bonded to the first surface 21*a*.

The pressurizing chambers 62 form a pressurizing chamber row arrayed in the longitudinal direction. The pressurizing chambers 62 in two adjacent pressurizing chamber rows are arranged in a staggered manner between the two pressurizing chamber rows. In addition, one pressurizing chamber group includes four pressurizing chamber rows connected to one supply manifold 61. In the example illustrated in FIG. 4, the channel member 21 includes four pressurizing chamber groups.

Furthermore, relative arrangements of the pressurizing chambers 62 within individual pressurizing chamber groups are configured in the same manner, and the pressurizing chamber groups are arranged in a manner such that they are slightly shifted from each other in the longitudinal direction.

The discharge holes 63 are disposed at positions of the channel member 21 other than a region that is opposed to the supply manifold 61. That is, the discharge holes 63 do not overlap with the supply manifold 61 in a transparent view of the channel member 21 from the first surface 21*a* side.

Furthermore, in a plan view, the discharge holes 63 are disposed within a region in which the piezoelectric actuator substrate 22 is mounted. One group of such discharge holes 63 occupies a region having approximately the same size and shape as the piezoelectric actuator substrate 22.

Then, the displacement element 70 (see FIG. 6) of a corresponding piezoelectric actuator substrate 22 is caused to be displaced, thereby discharging droplets from the discharge hole 63.

As illustrated in FIG. 6, the channel member 21 has a layered structure in which a plurality of plates are layered. These plates include a cavity plate 21A, a base plate 21B, an aperture plate 21C, a supply plate 21D, manifold plates 21E, 21F, and 21G, a cover plate 21H, and a nozzle plate 21I arranged in this order from the upper surface of the channel member 21.

A large number of holes are formed in these plates. The thickness of each of the plates is approximately 10 μm to approximately 300 μm. With this configuration, the holes can be formed with high accuracy. The individual plates are layered while aligned with respect to each other such that these holes communicate with each other to form a predetermined channel.

In the channel member 21, the supply manifold 61 and the discharge hole 63 communicate through an individual channel 64. The supply manifold 61 is located on the second surface 21*b* side within the channel member 21, and the discharge hole 63 is located at the second surface 21*b* of the channel member 21.

The individual channel 64 includes a pressurizing chamber 62 and an individual supply channel 65. The pressurizing chamber 62 is located at the first surface 21*a* of the channel member 21. The individual supply channel 65 serves as a channel that connects the supply manifold 61 and the pressurizing chamber 62.

In addition, the individual supply channel 65 includes a reduction portion 66 having a width narrower than other portions. The reduction portion 66 has a width narrower than other portions of the individual supply channel 65, and hence, has a high channel resistance. In this manner, when the channel resistance of the reduction portion 66 is high, pressure occurring at the pressurizing chamber 62 is less likely to escape to the supply manifold 61.

The piezoelectric actuator substrate 22 includes piezoelectric ceramic layers 22A and 22B, a common electrode 71, an individual electrode 72, a connecting electrode 73, a dummy connecting electrode 74, and a front surface electrode 75 (see FIG. 4).

The piezoelectric actuator substrate 22 has the piezoelectric ceramic layer 22A, the common electrode 71, the piezoelectric ceramic layer 22B, and the individual electrode 72 layered in this order.

Both of the piezoelectric ceramic layers 22A and 22B each extend over the first surface 21*a* of the channel member 21 so as to extend across the plurality of pressurizing chambers 62. The piezoelectric ceramic layers 22A and 22B each have a thickness of approximately 20 μm. For example, the piezoelectric ceramic layers 22A and 22B are made of a lead zirconate titanate (PZT)-based ceramic material having ferroelectricity.

The common electrode 71 is formed over substantially the entire surface in a surface direction of a region between the piezoelectric ceramic layer 22A and the piezoelectric ceramic layer 22B. That is, the common electrode 71 overlaps with all the pressurizing chambers 62 in the region that is opposed to the piezoelectric actuator substrate 22.

The thickness of the common electrode 71 is approximately 2 μm. For example, the common electrode 71 is made of a metal material such as a Ag—Pd based material.

The individual electrode 72 includes a body electrode 72*a* and an extraction electrode 72*b*. The body electrode 72*a* is located in a region of the piezoelectric ceramic layer 22B that is opposed to the pressurizing chamber 62. The body electrode 72*a* is slightly smaller than the pressurizing chamber 62, and has a shape substantially similar to that of the pressurizing chamber 62.

The extraction electrode 72*b* is drawn out from the body electrode 72*a* to be outside the region that is opposed to the pressurizing chamber 62. The individual electrode 72 is made of, for example, a metal material such as a Au-based material.

The connecting electrode 73 is located on the extraction electrode 72*b*, and is formed to have a convex shape with a thickness of approximately 15 μm. The connecting electrode 73 is electrically connected to an electrode provided at the signal transmission member 31 (see FIG. 3). The connecting electrode 73 is made of, for example, silver-palladium, including glass frit.

The dummy connecting electrode 74 is located on the piezoelectric ceramic layer 22B and is positioned so as not to overlap with various electrodes such as the individual electrode 72. The dummy connecting electrode 74 connects the piezoelectric actuator substrate 22 and the signal transmission member 31, and increases the connection strength.

Furthermore, the dummy connecting electrode 74 makes uniform the distribution of the contact positions between the piezoelectric actuator substrate 22 and the piezoelectric actuator substrate 22, and stabilizes the electrical connection. The dummy connecting electrode 74 is preferably made of a material equivalent to that of the connecting electrode 73, and is preferably formed in a process equivalent to that of the connecting electrode 73.

The front surface electrode 75 illustrated in FIG. 4 is formed on the piezoelectric ceramic layer 22B and at a position that does not interfere with the individual electrode 72. The front surface electrode 75 is connected to the common electrode 71 through a via hole formed in the piezoelectric ceramic layer 22B.

With this configuration, the front surface electrode 75 is grounded and maintained at the ground electric potential. The front surface electrode 75 is preferably made of a material equivalent to that of the individual electrode 72, and is preferably formed in a process equivalent to that of the individual electrode 72.

A plurality of the individual electrodes 72 are individually electrically connected to the controller 14 (see FIG. 1) via the signal transmission member 31 and wiring, in order to individually control the electric potential of each individual electrode 72. By setting the individual electrode 72 and the common electrode 71 to have different electric potentials, and applying an electric field in the polarization direction of the piezoelectric ceramic layers 22A, the portion of the piezoelectric ceramic layer 22A to which the electric field is applied operates as an activation section distorted due to a piezoelectric effect.

In other words, in the piezoelectric actuator substrate 22, portions of the individual electrode 72, the piezoelectric ceramic layer 22A, and the common electrode 71 that are opposed to the pressurizing chamber 62 function as the displacement element 70.

In addition, unimorph deformation of the displacement element 70 results in the pressurizing chamber 62 being pressed and a liquid being discharged from the discharge hole 63.

Next, a drive procedure of the liquid discharge head 8 according to the embodiment will be described. The individual electrode 72 is set to be a higher electric potential (hereinafter, also referred to as a high electric potential) than the common electrode 71 in advance. Then, each time a discharge request is made, the individual electrode 72 is once set to be the same electric potential (hereinafter, referred as a "low electric potential") as the common electrode 71, and then is again set to the high electric potential at a predetermined timing.

With this configuration, at the timing when the individual electrode 72 changes to the low electric potential, the piezoelectric ceramic layers 22A and 22B return to their original shapes, and the volume of the pressurizing chamber 62 increases to be higher than the initial state, that is, higher than the state of the high electric potential.

At this time, negative pressure is applied to the inside of the pressurizing chamber 62. Thus, a liquid in the supply manifold 61 is sucked into the interior of the pressurizing chamber 62.

After this, the piezoelectric ceramic layers 22A and 22B deform so as to protrude toward the pressurizing chamber 62 at the timing when the individual electrode 72 is again set to the high electric potential.

In other words, the inside of the pressurizing chamber 62 has a positive pressure as a result of a reduction in the volume of the pressurizing chamber 62. Thus, the pressure of the liquid within the pressurizing chamber 62 rises, and droplets are discharged from the discharge hole 63.

In other words, in order to discharge droplets from the discharge hole 63, the controller 14 supplies a drive signal including pulses based on the high electric potential to the individual electrode 72 using the driver IC 33. It is only necessary to set the pulse width to an acoustic length (AL) that is a length of time when a pressure wave propagates from the reduction portion 66 to the discharge hole 63.

With this configuration, when the inside of the pressurizing chamber 62 changes from the negative pressure state to the positive pressure state, the pressures under both of the states are combined, which makes it possible to discharge the droplets with higher pressure.

In addition, in a case of gray scale printing, the gray scale is expressed based on the number of droplets continuously discharged from the discharge hole 63, that is, the amount (volume) of droplets adjusted based on the number of times the droplets are discharged. Thus, the droplets are discharged a number of times corresponding to the designated gray scale to be expressed, through the discharge hole 63 corresponding to the designated dot region.

In general, when the liquid discharge is continuously performed, an interval between the pulses that are supplied to discharge the droplets may be set to the AL. Due to this, a period of a residual pressure wave of pressure generated in discharging the droplets discharged earlier matches a period of a pressure wave of pressure to be generated in discharging droplets to be discharged later.

Thus, the residual pressure wave and the pressure wave are superimposed, whereby the droplets can be discharged with a higher pressure. Note that in this case, the speed of the droplets to be discharged later is increased, and the impact points of the plurality of droplets become close.

Details of Pressing Member

Figure 8:
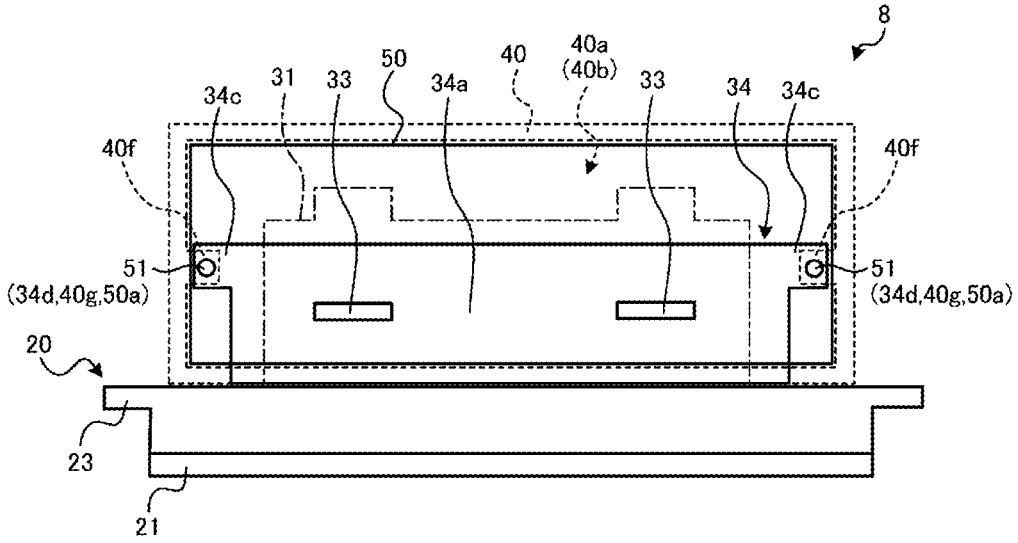
FIG. 8 is a schematic view illustrating a side surface of the liquid discharge head according to the embodiment.

Next, details of the pressing member 34 according to the embodiment will be described with reference to FIGS. 7A, 7B and 8. FIG. 7A and FIG. 7B are cross-sectional schematic views used to explain the structure of the pressing member 34 according to the embodiment and the vicinity of the pressing member 34. FIG. 8 is a schematic view illustrating a side surface of the liquid discharge head 8 according to the embodiment. Note that, in FIG. 8, the signal transmission member 31 and the housing 40 are illustrated using a long dashed short-dashed line or a dashed line, for the purpose of facilitating understanding.

As illustrated in FIG. 7A, the pressing member 34 is formed so as to be substantially U-shaped in a cross-sectional view in which the upper side is open. The pressing member 34 includes a pressing portion 34*a*, a connecting portion 34*b*, and a protruding portion 34*c*.

A pair of pressing portions 34*a* are located substantially parallel to each other, and are formed so as to extend in the main scanning direction. The pressing portions 34*a* are provided so as to be opposed to the driver ICs 33 through the elastic members 35 and the signal transmission members 31.

The connecting portion 34*b* is formed so as to be opposed to the head body 20 (see FIG. 8) and extend in the main scanning direction. The connecting portion 34*b* connects the pair of pressing portions 34*a*. The connecting portion 34*b* is fixed to the reservoir 23 (see FIG. 8) of the head body 20 using a screw or the like (not illustrated).

As illustrated in FIG. 8, the protruding portion 34*c* is provided so as to protrude toward the outside from each of both end portions of the pressing portion 34*a* in the main scanning direction. A circular hole 34*d* is formed in the protruding portion 34*c*. A screw groove is formed at the inner wall of the circular hole 34*d*.

The housing 40 that houses the pressing member 34 includes protruding portions 40*f*. The protruding portions 40*f* are provided so as to protrude toward the inner side from a side surface of the housing 40 in the main scanning direction. That is, the protruding portions 40*f* are provided so as to protrude toward the first opening 40*a* and the second opening 40*b*.

In addition, the protruding portions 40*f* are provided at a position corresponding to the protruding portions 34*c* of the pressing member 34. Furthermore, in each of the protruding portions 40*f*, a circular hole 40*g* is formed at a position corresponding to the circular hole 34*d* described above.

In addition, each of the heat dissipation plates 50 includes circular holes 50*a* formed at positions corresponding to the circular holes 34*d* and the circular holes 40*g*.

Furthermore, in the embodiment, as illustrated in FIG. 7A, the elastic member 35, the signal transmission member 31, and the driver IC 33 are disposed so as to be layered in this order and be in contact with the outer wall of the pressing portion 34*a* of the pressing member 34.

In addition, the housing 40 is disposed so that the inner wall of the protruding portion 40*f* is in contact with the outer wall of the protruding portion 34*c* of the pressing portion 34*a*. Note that, at this time, the housing 40 is disposed so that the positions of the circular holes 40*g* are aligned with the positions of the circular holes 34*d*.

Furthermore, the heat dissipation plate 50 is disposed so as to close the first opening 40*a* (or the second opening 40*b*) of the housing 40 and be in contact with the outer wall of the protruding portion 40*f*. Note that, at this time, the heat dissipation plate 50 is disposed so that the positions of the circular holes 50*a* are aligned with the positions of the circular holes 34*d* and the circular holes 40*g*.

In addition, the screws 51 are inserted from the outside of the heat dissipation plate 50 into the circular holes 50*a*, the circular holes 40*g*, and the circular holes 34*d* that communicate with each other, and the screws 51 are screwed into the circular holes 34*d*. With this configuration, the protruding portion 40*f* of the housing 40 is sandwiched between the protruding portion 34*c* of the pressing member 34 and the heat dissipation plate 50, as illustrated in FIG. 7B.

That is, by fastening the screws 51, the pressing member 34 is fixed to the heat dissipation plate 50 in a state of being spaced apart by a predetermined distance (by the thickness of the protruding portion 40*f*). Here, in the embodiment, the protruding portion 40*f* is designed such that the thickness of the protruding portion 40*f* is greater than the thickness of the driver IC 33, and the thickness of the protruding portion 40*f* is smaller than the total thickness of the elastic member 35, the signal transmission member 31, and the driver IC 33.

With this configuration, as illustrated in FIG. 7B, it is possible to cause the elastic member 35 to contract between the pressing member 34 and the heat dissipation plate 50. In addition, in the embodiment, with the contracting of the elastic member 35, it is possible to favorably bring the driver IC 33 into close contact with the heat dissipation plate 50.

That is, with the embodiment, by fixing the heat dissipation plate 50 to the pressing member 34 using the screw 51, it is possible to favorably bring the driver IC 33 into close contact with the heat dissipation plate 50.

In addition, in the embodiment, by disposing the protruding portion 40*f* of the housing 40 between the pressing member 34 and the heat dissipation plate 50, it is possible to bring the heat dissipation plate 50 into contact with the housing 40. This makes it possible to dissipate heat generated from the driver IC 33 not only by using the heat dissipation plate 50 but also by using the housing 40. Thus, with the embodiment, it is possible to favorably dissipate heat generated by the driver IC 33.

Furthermore, in the embodiment, the protruding portion 40*f* of the housing 40 is sandwiched between the pressing member 34 and the heat dissipation plate 50, which makes it possible to also fix the pressing member 34 to the housing 40. This makes it possible to improve the force for supporting the pressing member 34 within the liquid discharge head 8.

In addition, in the embodiment, the protruding portion 40*f* of the housing 40 is sandwiched between the pressing member 34 and the heat dissipation plate 50, which enables the protruding portion 40*f* to function as a spacer. This makes it possible to prevent the driver IC 33 from being erroneously broken at the time of fastening the screw 51.

In addition, in the embodiment, it is preferable that the heat dissipation plate 50 be fixed to the pressing member 34 at a position that is spaced further apart from the head body 20 than the driver IC 33, as illustrated in FIG. 8. That is, it is preferable that the circular hole 50*a*, the circular hole 34*d*, and the circular hole 40*g* be provided at positions higher than the driver IC 33 when the head body 20 is directed downward, and the heat dissipation plate 50 is fixed to the pressing member 34 at a position higher than the driver IC 33. This makes it possible to firmly press the driver IC 33 against the heat dissipation plate 50.

In other words, the driver IC 33 is located between the position where the heat dissipation plate 50 and the pressing member 34 are fixed to each other and the position where the pressing member 34 and the head body 20 are fixed to each other. Thus, when the heat dissipation plate 50 is fixed to the pressing member 34, the driver IC 33 is firmly pressed against the heat dissipation plate 50.

Furthermore, in the embodiment, it is preferable that the heat dissipation plate 50 be fixed to the pressing member 34 at each of both end portions thereof in the longitudinal direction. With this configuration, in a case where a plurality of driver ICs 33 are provided for one signal transmission member 31, it is possible to uniformly press the heat dissipation plate 50 against the plurality of driver ICs 33.

Thus, with the embodiment, it is possible to favorably bring the plurality of driver ICs 33 against the heat dissipation plate 50.

Note that the pressing member 34 need not include the protruding portion 34*c*. In this case, it is only necessary that the heat dissipation plate 50 be fixed to the pressing portion 34*a*. In addition, the housing 40 need not include the protruding portion 40*f*, and it does not necessarily have to be located between the pressing member 34 and the heat dissipation plate 50. Furthermore, the present embodiment gives an example in which the pressing member 34 and the heat dissipation plate 50 are fixed to each other using the screw 51. However, they may be fixed to each other using an adhesive made, for example, of resin, or by fitting the members together.

Various Variations

Figure 9:
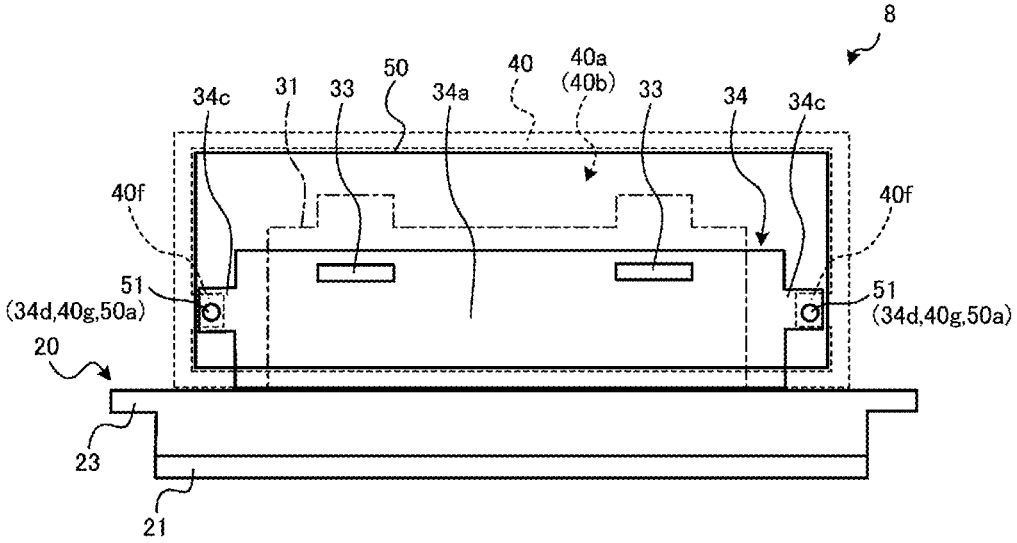
FIG. 9 is a schematic view illustrating a side surface of a liquid discharge head according to a first variation of the embodiment.

Various variations of the liquid discharge head 8 according to the embodiment will be described with reference to FIGS. 9 to 14. FIG. 9 is a schematic view illustrating a side view of a liquid discharge head 8 according to a first variation of the embodiment.

Note that, in the various variations below, redundant explanations are omitted, with parts that are the same as those in the embodiment described above denoted by the same reference numerals.

In the liquid discharge head 8 according to a first variation, the heat dissipation plate 50 is fixed to the pressing member 34 at a position closer to the head body 20 than the driver IC 33 as illustrated in FIG. 9. That is, in the first variation, the circular hole 50*a*, the circular hole 34*d*, and the circular hole 40*g* are provided at a position lower than the driver IC 33 when the head body 20 is directed downward, and the heat dissipation plate 50 is fixed to the pressing member 34 at a position lower than the driver IC 33.

With this configuration, the pressing member 34 can be fixed to or around the connecting portion 34*b* (see FIG. 7A and FIG. 7B) that is a portion of the pressing member 34 having a high rigidity. This makes it possible to improve the force for supporting the pressing member 34 within the liquid discharge head 8.

Figure 10:
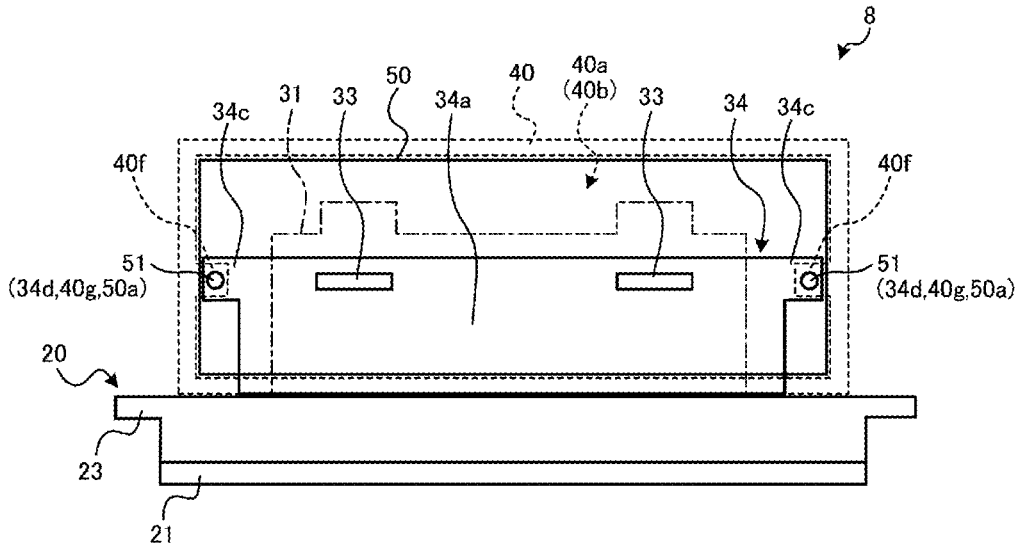
FIG. 10 is a schematic view illustrating a side surface of a liquid discharge head according to a second variation of the embodiment.

FIG. 10 is a schematic view illustrating a side surface of a liquid discharge head 8 according to a second variation of the embodiment.

As illustrated in FIG. 10, in the liquid discharge head 8 according to the second variation, the heat dissipation plate 50 is fixed to the pressing member 34 at a portion disposed at the same distance from the head body 20 as the driver IC 33. That is, in the second variation, the circular hole 50*a*, the circular hole 34*d*, and the circular hole 40*g* are provided at the same height as the driver IC 33 when the head body 20 is directed downward, and the heat dissipation plate 50 is fixed to the pressing member 34 at the same height as the driver IC 33.

With this configuration, it is possible to dispose the driver IC 33 so as to be substantially flush with the pair of screws 51 used to fix the pressing member 34 and the heat dissipation plate 50 to each other. Thus, with a second variation, two screws 51 are fastened, which makes it possible to smoothly transfer, to the driver IC 33, the force that causes the pressing member 34 and the heat dissipation plate 50 to be sandwiched. This makes it possible to further favorably bring the driver IC 33 into close contact with the heat dissipation plate 50.

Note that the "heat dissipation plate 50 is fixed at the same distance from the head body 20 as the driver IC 33" means that the heat dissipation plate 50 is fixed at a position extended in the longitudinal direction from the position where the driver IC 33 is pressed by the heat dissipation plate 50, as illustrated in FIG. 10. In other words, in the pressing member 34, the position where the heat dissipation plate 50 presses the driver IC 33 and the position where the heat dissipation plate 50 is fixed are aligned in the longitudinal direction.

Figure 11:
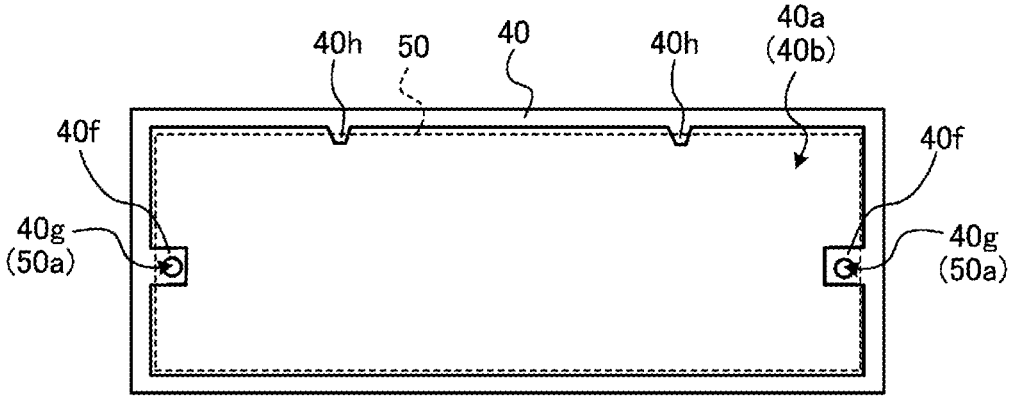
FIG. 11 is a schematic view illustrating a side surface of a housing according to a third variation of the embodiment.

FIG. 11 is a schematic view illustrating a side surface of a housing 40 according to a third variation of the embodiment. Note that, in FIG. 11, the heat dissipation plate 50 is illustrated with a dashed line for the purpose of facilitating understanding.

As illustrated in FIG. 11, the housing 40 according to the third variation includes an engaging tab 40*h* used to lock the heat dissipation plate 50. A pair of the engaging tabs 40*h* are provided, for example, so as to protrude toward the inner side from the upper surface of the housing 40.

In the third variation, by providing the housing 40 with the engaging tab 40*h*, it is possible to improve the efficiency with which the heat dissipation plate 50 is fitted to the first opening 40*a* (or the second opening 40*b*) of the housing 40. Note that, in the example illustrated in FIG. 11, a pair of engaging tabs 40*h* are provided at the upper surface side of the housing 40; however, the arrangement and number of engaging tabs 40*h* are not limited to this example.

Figure 12:
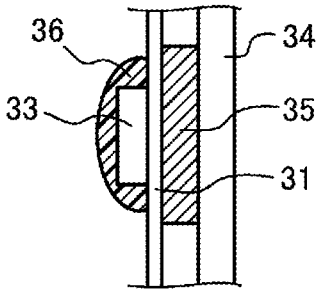
FIG. 12 is an enlarged cross-sectional view used to explain a structure around a driver IC according to a fourth variation of the embodiment.

FIG. 12 is an enlarged cross-sectional view used to explain a structure around a driver IC 33 according to a fourth variation of the embodiment. Note that FIG. 12 is a diagram illustrating a state (corresponding to FIG. 7A in the embodiment) before the heat dissipation plate 50 is brought into close contact with the driver IC 33.

As illustrated in FIG. 12, in the fourth variation, a heat dissipating resin 36 is provided at the front surface of the driver IC 33 before the heat dissipation plate 50 is brought into close contact with the driver IC 33. With this configuration, in the liquid discharge head 8 according to the fourth variation, the heat dissipating resin 36 can be provided between the driver IC 33 and the heat dissipation plate 50.

For example, the heat dissipating resin 36 is made of grease containing thermal conductive filler such as aluminum filler, and has high thermal conductivity.

In the fourth variation, the heat dissipating resin 36 is provided between the driver IC 33 and the heat dissipation plate 50. This makes it possible to reduce the thermal resistance at the interface between the driver IC 33 and the heat dissipation plate 50, which makes it possible to favorably dissipate heat generated by the driver IC 33.

In addition, in the fourth variation, it is preferable that the heat dissipating resin 36 cover the driver IC 33, as illustrated in FIG. 12. This enables the heat to be dissipated from the side surface of the driver IC 33 to the heat dissipation plate 50, which makes it possible to further favorably dissipate heat generated by the driver IC 33.

In addition, the heat dissipating resin 36 may be provided on the screw 51 (see FIG. 7A and FIG. 7B). That is, after the pressing member 34 and the heat dissipation plate 50 are fixed using the screw 51, the heat dissipating resin 36 may be applied. This makes it possible to strengthen the connection between the pressing member 34 and the heat dissipation plate 50, and also makes it possible to improve the heat dissipating property of the heat dissipation plate 50.

Figure 13:
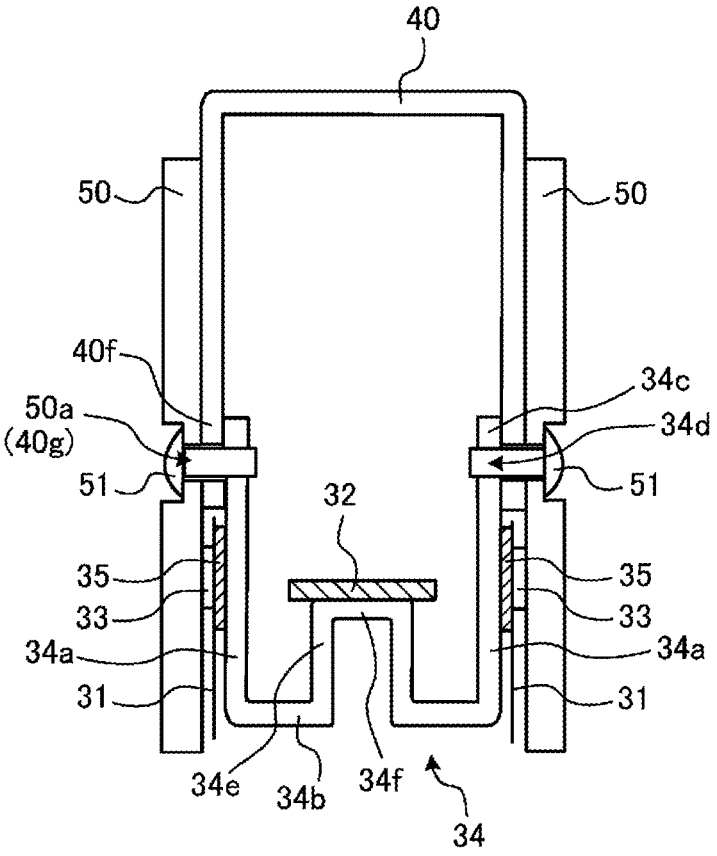
FIG. 13 is a cross-sectional schematic view used to explain a structure of a pressing member according to a fifth variation of the embodiment and a structure around the pressing member.

FIG. 13 is a cross-sectional schematic view used to explain a structure of a pressing member 34 according to a fifth variation of the embodiment and the vicinity of the pressing member 34. The configuration of the pressing member 34 differs between the fifth variation illustrated in FIG. 13 and the embodiment.

Specifically, in the pressing member 34 according to the fifth variation, a projecting portion 34*e* is provided at the connecting portion 34*b* formed so as to be opposed to the head body 20 (see FIG. 8) and extend in the main scanning direction.

The projecting portion 34*e* protrudes from the connecting portion 34*b* in the same direction (the upward direction in the drawing) as a direction in which the pressing portion 34*a* extends, and is formed so as to extend in the main scanning direction in a plan view. That is, the pressing member 34 according to the fifth variation is substantially W-shaped in which the upper side is open in a cross-sectional view.

With this configuration, it is possible to enhance the force of pressing the driver IC 33 disposed on the signal transmission member 31 from the inner side toward the heat dissipation plate 50, as compared with a case where the pressing member 34 is substantially U-shaped in a cross-sectional view. Thus, with the fifth variation, it is possible to further favorably bring the driver IC 33 into close contact with the heat dissipation plate 50.

Furthermore, the pressing member 34 according to the fifth variation includes a flat portion 34*f* at a tip portion of the projecting portion 34*e*, the flat portion having a substantially flat shape. In addition, in the fifth variation, the wiring board 32 is fixed to the flat portion 34*f*.

This configuration eliminates the need to provide another member for fixing the wiring board 32 within the liquid discharge head 8. This makes it possible to reduce the manufacturing cost of the liquid discharge head 8, and also makes it possible to firmly fix the wiring board 32 within the liquid discharge head 8.

Figure 14:
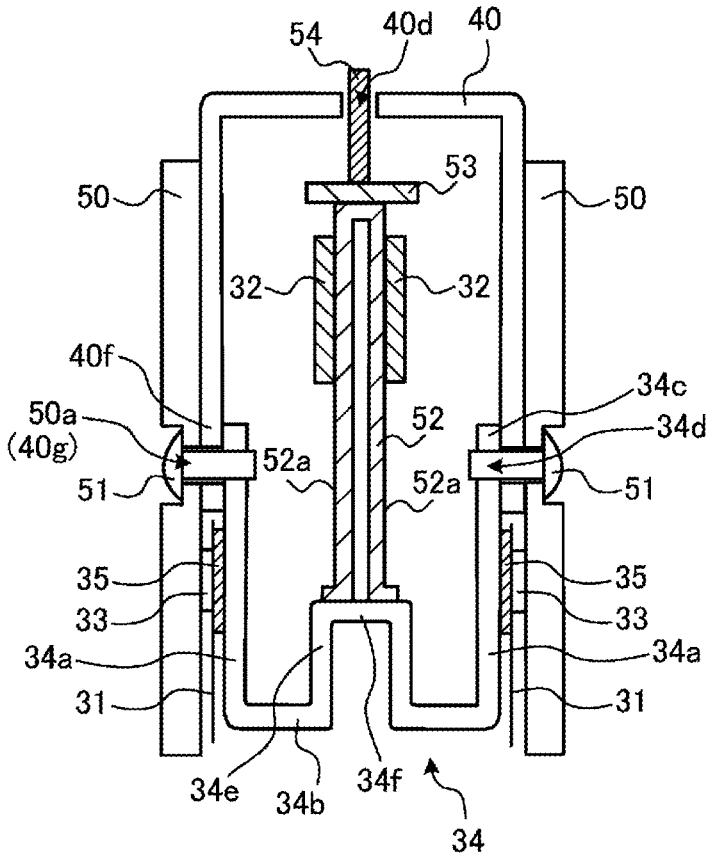
FIG. 14 is a cross-sectional schematic view used to explain a structure of a pressing member according to a sixth variation of the embodiment and a structure around the pressing member.

FIG. 14 is a cross-sectional schematic view used to explain the structure of a pressing member 34 according to a sixth variation of the embodiment and the vicinity of the pressing member 34. The configuration for supporting the wiring board 32 differs between the sixth variation illustrated in FIG. 14 and the fifth variation.

Specifically, in the sixth variation, a wall-shaped support member 52 is provided so as to stand on the flat portion 34*f* of the pressing member 34, and a plurality of wiring boards 32 are fixed to main surfaces 52*a* on both sides of the support member 52. With this configuration, it is possible to provide a plurality of wiring boards 32 within the liquid discharge head 8.

In addition, a wiring board 53 is provided at a tip portion of the support member 52, and a connector 54 is provided on the wiring board 53. Furthermore, the connector 54 and the wiring board 32 are electrically connected to each other through the wiring board 53 or the like.

The connector 54 is inserted into a fourth opening 40*d* formed at the upper surface of the housing 40, and protrudes to the outside from the fourth opening 40*d*. A portion between the connector 54 and the fourth opening 40*d* is filled with resin or the like (not illustrated).

With the sixth variation that has been described, it is possible to dissipate heat generated by the driver IC 33, to the housing 40 through the pressing member 34, the support member 52, the wiring board 32, and the connector 54. Thus, with the sixth variation, it is possible to further favorably dissipate heat generated by the driver IC 33.

Although embodiments of the present disclosure are described above, the present disclosure is not limited to the embodiments described above, and various modifications can be made without departing from the spirit thereof. For example, the embodiment described above has been described by giving an example in which the driver IC 33 is mounted at each of the pair of signal transmission members 31 and the pair of heat dissipation plates 50 are brought into close contact with the driver ICs 33. However, the number of the signal transmission members 31 and the number of the heat dissipation plates 50 are not limited to this example.

For example, it may be possible to employ a configuration in which the driver IC 33 is mounted on one signal transmission member 31, and one heat dissipation plate 50 is brought into close contact with this driver IC 33. Note that, in this case, it is preferable that the pressing member 34 be substantially L-shaped in a cross-sectional view.

In this manner, the liquid discharge head 8 according to the embodiment includes the head body 20, the driver IC 33, the housing 40, the heat dissipation plate 50, and the pressing member 34. The head body 20 includes the discharge hole 63 configured to discharge a liquid. The driver IC 33 controls driving of the head body 20. The housing 40 is located on the head body 20, and includes an opening (the first opening 40*a* and the second opening 40*b*) at a side surface. The heat dissipation plate 50 is located at the opening (the first opening 40*a*, the second opening 40*b*) of the housing 40, and is configured to dissipate heat generated by the driver IC 33. The pressing member 34 presses the driver IC 33 against the heat dissipation plate 50. In addition, the heat dissipation plate 50 is fixed to the pressing member 34. With this configuration, it is possible to favorably bring the driver IC 33 into close contact with the heat dissipation plate 50.

Furthermore, in the liquid discharge head 8 according to the embodiment, the pressing member 34 is fixed to the head body 20, and the heat dissipation plate 50 is fixed to the pressing member 34 at a position that is spaced further apart from the head body 20 than the driver IC 33. This makes it possible to firmly press the driver IC 33 against the heat dissipation plate 50.

In addition, in the liquid discharge head 8 according to the embodiment, the pressing member 34 is fixed to the head body 20, and the heat dissipation plate 50 is fixed to the pressing member 34 at a position closer to the head body 20 than the driver IC 33. With this configuration, it is possible to improve the force for supporting the pressing member 34 within the liquid discharge head 8.

Furthermore, in the liquid discharge head 8 according to the embodiment, the pressing member 34 is fixed to the head body 20, and the heat dissipation plate 50 is fixed to the pressing member 34 at a portion disposed at the same distance from the head body 20 as the driver IC 33. With this configuration, it is possible to further favorably bring the driver IC 33 into close contact with the heat dissipation plate 50.

In addition, in the liquid discharge head 8 according to the embodiment, at least a portion (protruding portion 40*f*) of the housing 40 is sandwiched between the heat dissipation plate 50 and the pressing member 34. With this configuration, it is possible to favorably dissipate heat generated by the driver IC 33.

Furthermore, in the liquid discharge head 8 according to the embodiment, the housing 40 includes the engaging tab 40*h* used to lock the heat dissipation plate 50. With this configuration, it is possible to improve the efficiency with which the heat dissipation plate 50 is fitted to the first opening 40*a* or the second opening 40*b* of the housing 40.

In addition, in the liquid discharge head 8 according to the embodiment, the heat dissipating resin 36 is provided between the driver IC 33 and the heat dissipation plate 50. With this configuration, it is possible to favorably dissipate heat generated by the driver IC 33.

In addition, in the liquid discharge head 8 according to the embodiment, the driver IC 33 is covered with the heat dissipating resin 36. With this configuration, it is possible to further favorably dissipate heat generated by the driver IC 33.

In addition, in the liquid discharge head 8 according to the embodiment, the pressing member 34 includes: the pair of pressing portions 34*a* configured to press the plurality of driver ICs 33 toward the outside; the connecting portion 34*b* that connects the pair of pressing portions 34*a*; and the projecting portion 34*e* provided at the connecting portion 34*b* and protruding from the connecting portion 34*b* in the same direction as the direction in which the pair of pressing portions 34*a* extend. With this configuration, it is possible to further favorably bring the driver IC 33 into close contact with the heat dissipation plate 50.

Furthermore, in the liquid discharge head 8 according to the embodiment, the projecting portion 34*e* includes the flat portion 34*f* provided at a tip portion of the projecting portion 34*e* and having a substantially flat shape, and the wiring board 32 is fixed to the flat portion 34*f*. With this configuration, it is possible to reduce the manufacturing cost of the liquid discharge head 8, and it is also possible to firmly fix the wiring board 32 within the liquid discharge head 8.

In addition, in the liquid discharge head 8 according to the embodiment, the projecting portion 34*e* includes the flat portion 34*f* provided at a tip portion of the projecting portion 34*e* and having a substantially flat shape, and a plurality of wiring boards 32 are fixed to both main surfaces 52*a* of the support member 52 having a wall shape and provided so as to stand on the flat portion 34*f*. With this configuration, it is possible to provide a plurality of wiring boards 32 within the liquid discharge head 8.

The recording apparatus (printer 1) according to the embodiment includes the liquid discharge head 8, the conveyor (conveying rollers 6) configured to convey the recording medium (printing sheet P) to the liquid discharge head 8, and the controller 14 configured to control the liquid discharge head 8 as described above. With this configuration, it is possible to realize the printer 1 in which the driver IC 33 can be favorably brought into close contact with the heat dissipation plate 50.

The disclosed embodiments should be considered as illustrative and not limiting in any point. In fact, the embodiments described above can be embodied in a variety of forms. Omission, replacement, and change can be made in various forms on the above embodiments without departing from the scope and the spirit of the appended claims.

The invention claimed is:

1. A liquid discharge head comprising:

a head body comprising a discharge hole configured to discharge a liquid;

a driver IC configured to control driving of the head body;

a housing located on the head body and comprising an opening at a side surface;

a heat dissipation plate located at the opening of the housing and configured to dissipate heat generated by the driver IC; and a pressing member configured to press the driver IC against the heat dissipation plate, wherein the heat dissipation plate is fixed to the pressing member.

2. The liquid discharge head according to claim 1, wherein the pressing member is fixed to the head body, and the heat dissipation plate is fixed to the pressing member at a position that is further from the head body than the driver IC.

3. The liquid discharge head according to claim 1, wherein the pressing member is fixed to the head body, and the heat dissipation plate is fixed to the pressing member at a position closer to the head body than the driver IC.

4. The liquid discharge head according to claim 1, wherein the pressing member is fixed to the head body, and the heat dissipation plate is fixed to the pressing member at a posiotion that is equidistant to the head body as the driver IC.

5. The liquid discharge head according to claim 1, wherein at least a portion of the housing is sandwiched between the heat dissipation plate and the pressing member.

6. The liquid discharge head according to claim 1, wherein the housing comprises an engaging tab used to lock the heat dissipation plate.

7. The liquid discharge head according claim 1, wherein a heat dissipating resin is provided between the driver IC and the heat dissipation plate.

8. The liquid discharge head according to claim 7, wherein the driver IC is covered with the heat dissipating resin.

9. The liquid discharge head according to claim 1, wherein the pressing member comprises:

a pair of pressing portions configured to press a plurality of the driver ICs outward;

a connecting portion that connects the pair of pressing portions; and a projecting portion provided at the connecting portion and protruding from the connecting portion in a same direction as a direction in which the pair of pressing portions extend.

10. The liquid discharge head according to claim 9, wherein the projecting portion comprises a flat portion provided at a tip portion of the projecting portion and having a substantially flat shape, and a wiring board is fixed to the flat portion.

11. The liquid discharge head according to claim 9, wherein the projecting portion comprises a flat portion provided at a tip portion of the projecting portion and having a substantially flat shape, and a wiring board is provided at a main surface of a support member having a wall shape and provided so as to stand on the flat portion.

12. A recording device comprising:

the liquid discharge head according to claim 1;

a conveyor configured to convey a recording medium to the liquid discharge head; and a controller configured to control the driver IC of the liquid discharge head.

13. The recording device according to claim 12, further comprising:

a frame configured to fix the liquid discharge head, wherein the heat dissipation plate is fixed to both end portions of the pressing member in a first direction, and the liquid discharge head is fixed to the frame at both end portions thereof in the first direction.

14. A recording device comprising:

the liquid discharge head according to claim 1; and an applicator configured to apply a coating agent over a recording medium.

15. A recording device comprising:

the liquid discharge head according to claim 1; and a dryer configured to dry a recording medium.

* * * * *